US006843246B2

(12) United States Patent
Shiue

(10) Patent No.: US 6,843,246 B2
(45) Date of Patent: Jan. 18, 2005

(54) SNORKEL SPLASH PROTECTOR

(75) Inventor: Chih-Cheng Shiue, Rancho Santa Fe, CA (US)

(73) Assignee: QDS Injection Molding LLC, Rancho Sante Fe, CA (US)

( * ) Notice: Subject to any disclaimer, the term of this patent is extended or adjusted under 35 U.S.C. 154(b) by 0 days.

(21) Appl. No.: 10/413,285

(22) Filed: Apr. 15, 2003

(65) Prior Publication Data

US 2004/0139969 A1 Jul. 22, 2004

(51) Int. Cl.[7] ..... B63C 11/16
(52) U.S. Cl. ..... 128/201.11; 128/201.27
(58) Field of Search ..... 128/201.11, 200.29, 128/201.27, 201.28, 201.26, 206.29; 405/186, 187; 181/127, 21

(56) References Cited

U.S. PATENT DOCUMENTS 2,362,240 A * 11/1944 Bonilla ..... 128/201.11
4,805,610 A * 2/1989 Hunt ..... 128/201.11
5,117,817 A * 6/1992 Lin ..... 128/201.11
5,267,556 A * 12/1993 Feng ..... 128/201.11
5,524,611 A * 6/1996 Fu ..... 128/201.11
5,622,165 A * 4/1997 Huang ..... 128/201.11
5,701,884 A * 12/1997 Fondas et al. ..... 128/201.11
5,893,362 A * 4/1999 Evans ..... 128/201.11
6,655,378 B2 * 12/2003 Swetish ..... 128/201.11
6,679,253 B1 * 1/2004 Feng ..... 128/201.11

FOREIGN PATENT DOCUMENTS

GB 2246075 A * 1/1992 ..... B63C/11/16

* cited by examiner

*Primary Examiner*—Henry Bennett
*Assistant Examiner*—Mital Patel
(74) *Attorney, Agent, or Firm*—Troxell Law Office PLLC

(57) ABSTRACT

A snorkel splash protector attached at an upper end of a snorkel and having a housing connected to an end of the snorkel tube, a float member and a top cover. A sidewall between a hollow tube and supports provides plurality of water and air inlet/outlet apertures. A middle portion between the supports and the hollow tube formed an axial passage. A float member is located on a top of the passage mounting a filler and forming an opening. A top cover is located on the housing. The float member moves between open or closed positions by its buoyancy, which can float under water, and down by its own weight when located above a water level.

6 Claims, 4 Drawing Sheets

A-A Sec.

B-B Sec.

SNORKEL SPLASH PROTECTOR

FIELD OF THE INVENTION

The present invention relates generally to the field of snorkels for diving and the like, and more specifically to the snorkels which are designed to prevent water from entering a snorkel tube while float diving, scuba-diving, swimming or the like.

BACKGROUND OF THE INVENTION

In a conventional snorkel, the opening at the top end thereof is only about 10–15 cm above the water level when the diver is floating. The tail end communicates with the diver's mouth, so a trifling carelessness (such as the snorkel is inclined) or a wave on the water surface may cause water to flow into the snorkel mouth and lead to the danger of swallowing water or choking the bronchia with water.

After purging water from a conventional snorkel, there is usually some residual water remaining in the lower portion of housing. Oftentimes the amount of this residual water is sufficiently little so that the diver may breathe past without significant "gurgling" noises, but is still enough to effectively reduce the breathing passage size such that breathing resistance is increased. Although the snorkel may equip the water valve, water is still hard to be repelled if water stays in some particular positions. Therefore divers must float to the water surface, take off the snorkel, and drain the water out, which is very inconvenient. However, decreasing the amount of water entering the snorkel becomes an important subject to the snorkel industry.

SUMMARY OF THE INVENTION

A snorkel splash protector attached at the upper end of the snorkel, the protector snaps into the end of the snorkel tube to prevent from water entering. The housing enable open or close the passage between snorkel tube and outside for air or water flow effectively.

The purpose of present invention is to provide a protector, which includes a float member uses its weight and buoyancy can prevent from water entering, attached to the end opening of a diving snorkel.

A housing with a passage adjacent to one side of said housing. Within the passage providing a float member which move up and down, the other side of passage provides a hollow tube, said single hollow tube allows air and water flow inlet and outlet smoothly.

Said float member is made by the material which density less than water, and in long rod shape which enable reach the top of opening by buoying quickly.

The present invention effectively uses several supports and a hollow tube surrounds the housing, and by using these hollow tubes, the float member is protected between. The float member can move vertically due to its position either below or above the water level. While under the water level, the float member moves upward, attached to the filler, and close the opening on the top, this way, neither water nor air can enter.

This present invention comprising the following components, which as:

A. A housing: Assembled by several supports and a hollow tube that surrounds a float member. It also allows the float member to move vertically to open or close the top opening. These hollow tubes allow air and water goes to the snorkel from the top cover to the snorkel, where this tube is the only path from the snorkel to the exterior.

B. A float member and filler: The float member has its density smaller than the water, supports and the hollow tube surround it. The hollow tube does not affect the float member's movement but it also remains the stability of the movement of the float member and allows the float member to correctly attach to the filler. When it goes under the water level, its buoyancy makes itself float upward; when it is above the water level, it moves downward caused by its weight. When the float member floats to a predetermined position, it will attach with the filler and close the opening of the housing. Water cannot enter the housing due to the float member and the filler. When the diver is above the water level, the float member will apart from the filler and allows the diver to inhale or exhale air.

C. A press plate: This press plate assists the filler mentioned above to attach to the opening of the protector. By applying appropriate pressure, it prevents water sneaks into the housing and snorkel between the float member and the filler.

D. A top cover: The hollow tubes merge on the top part of the housing and form a space; this top cover has the function of preventing water entering from the top.

The housing design of several supports and a hollow tube forms a space between therein having several functions: (1) allows air to be inhaled. (2) Protects the float member surrounds by the hollow tubes, so that there is no need to assemble another protecting cover and increase the water resistance and the housing volume. (3) The float member is only contacting the hollow tubes in lines or spots; therefore, the resistance between is decreased to the minimum and can still remain its stability. (4) The hollow tubes can direct the float member to move vertical strictly.

The shape of housing is not limited to the cylinder shape, it means, all other shapes can achieve the function of the present invention should be deemed as within the scope of the invention.

DETAILED DESCRIPTION OF PREFERRED EMBODIMENTS

Figure 1:
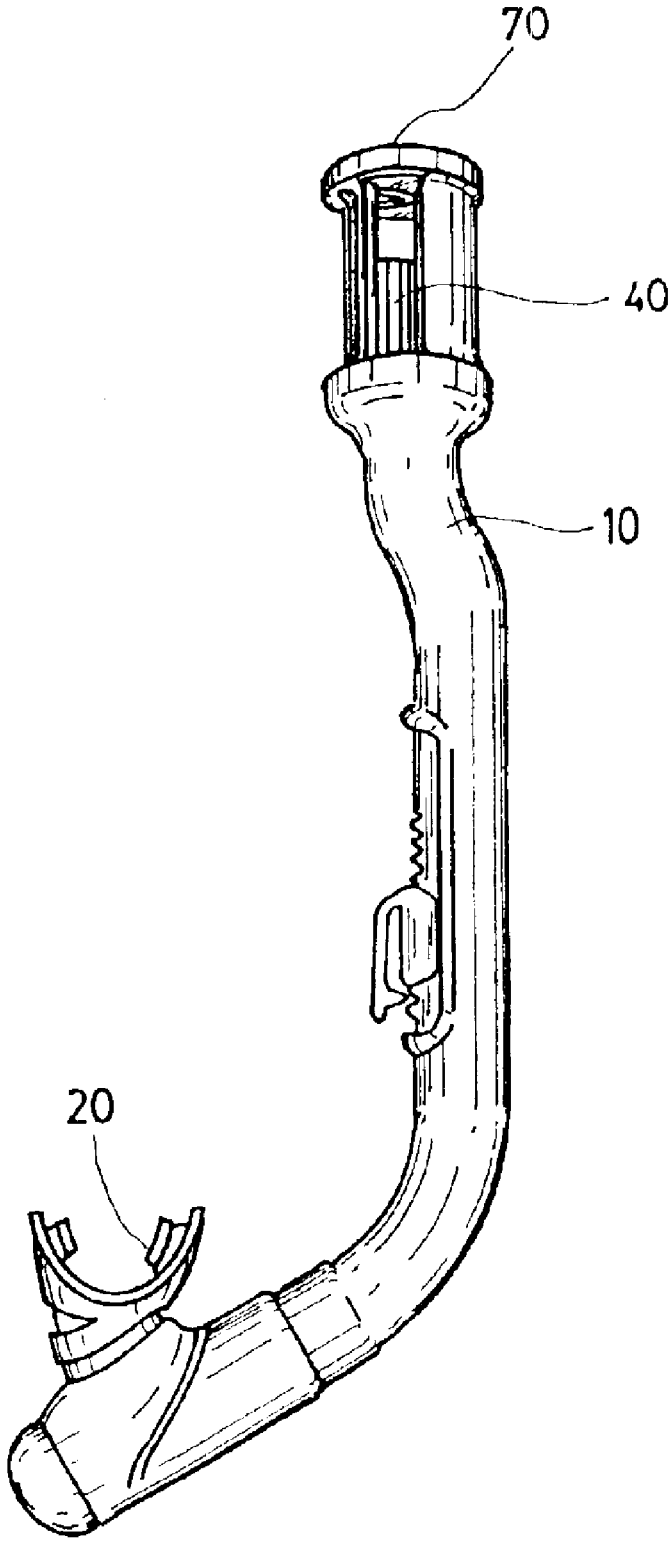
FIG. 1 is a front prospective view of a snorkel embodiment with the splash protector attachment of the present invention.

Referring to FIG. 1, the present invention provides a protector to the top end of a snorkel. This protector prevents from water entering the snorkel tube 10 to the mouthpiece 20.

Figure 2A:
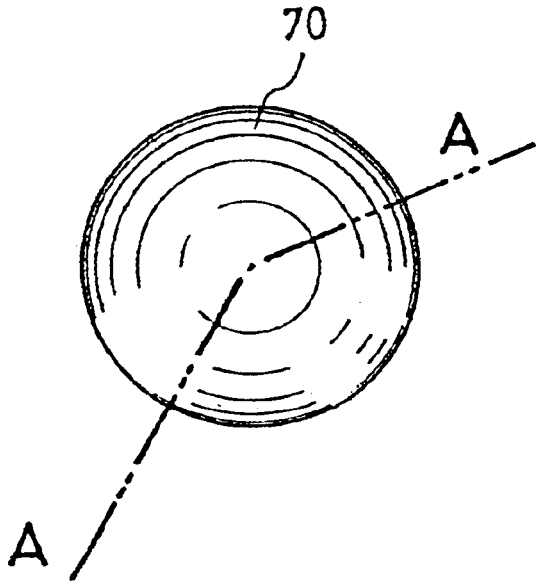
FIG. 2A is a top view of the present invention.
Figure 2B:
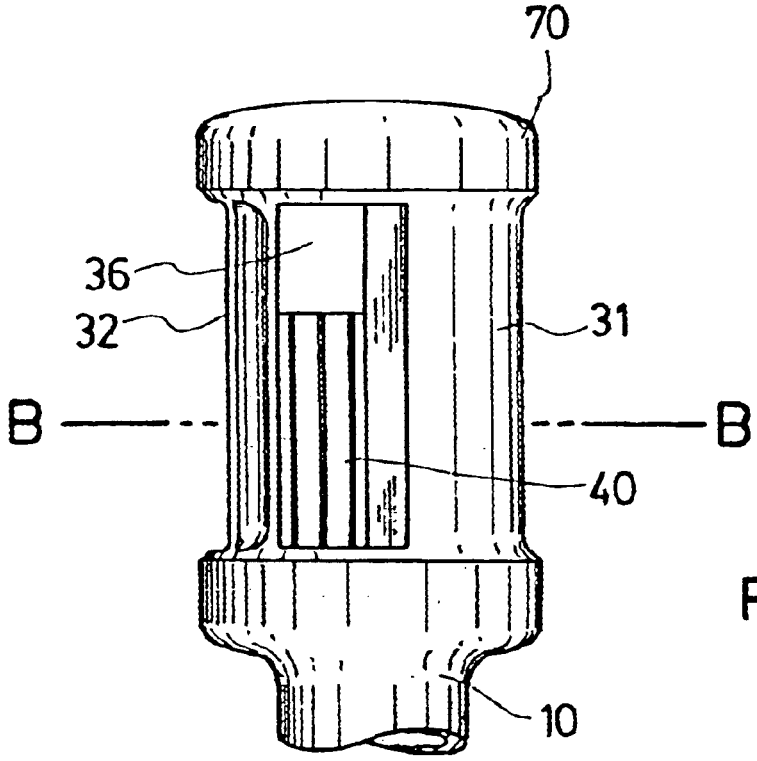
FIG. 2B is a front view of the present invention.
Figure 3:
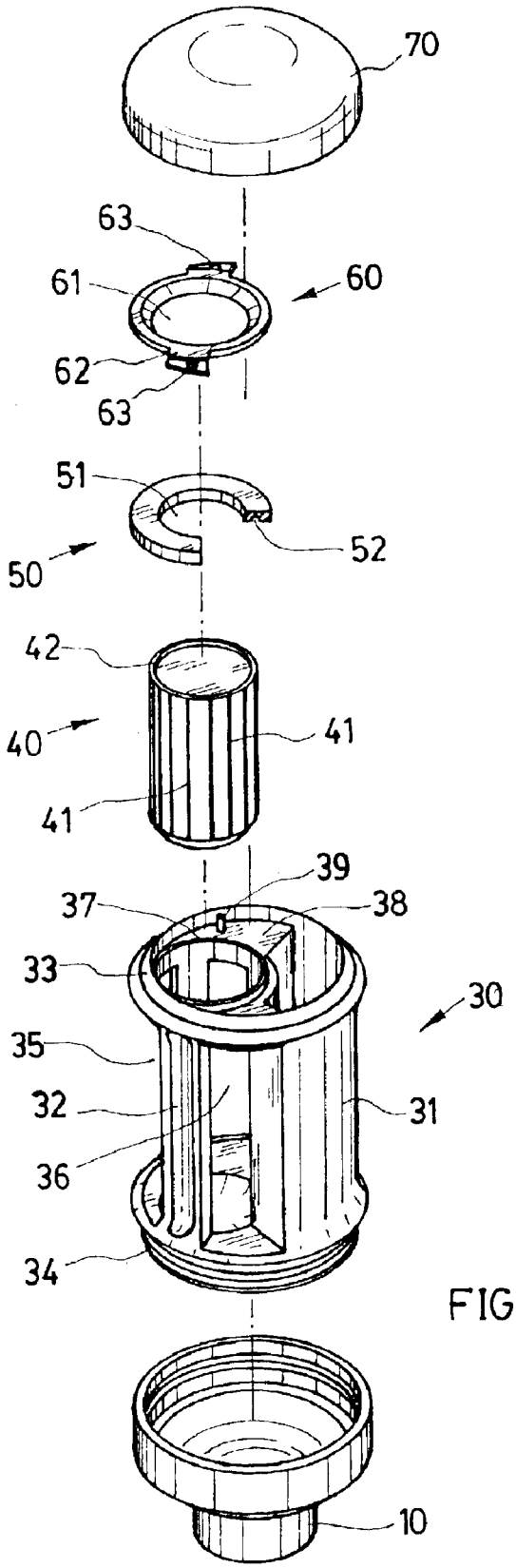
FIG. 3 is an exploded view of the protector.

Referring to FIGS. 2A, 2B and 3, the protector comprising a housing 30 which can be attached on the top end of snorkel tube 10, a float member 40, the filler 50, a press plate 60 and a top cover 70.

As shown in FIG. 2A to FIG. 5, the circumference of housing 30 is composed by a hollow tube 31 and plurality of support 32 with a top edge 33 and bottom edge 34. Apertures 35 are formed between hollow tube 31 and supports 32 on the sidewall of housing 30. Within the housing 30, the vertical tubing passage 36 formed between hollow tube 31 and supports 32. On the top of passage, circumferentially protrudes a ring 37, the top of exterior of passage 36, excepting the hollow tube 31, closed by the covering plate 38. On the top of covering plate 38 provides at least a tenon 39. Said top edge 33 covered closely with top cover 70, and bottom edge 34 covered closed with snorkel tube 10. Within the passage, locate a float member 40.

The float member 40 consists several protruding stripes 41 at its circumference, these protruding stripes 41 contacts the wall 311 of the hollow tubes 31 gradually and decrease the resistance to the minimum. The float member 40 can move vertically due to the height of the water level. The top surface 42 and the filler 50 can attach to each other closely to prevent from air and water entering.

The float member 40 is made by the small density material; and the shape is not limited to the shape of the preferred embodiment of the present invention.

The filler 50 is in ring shape made of silicone, rubber or some resilient materials. The center of it providing the hole 51, and a circle groove 52 is at the bottom portion of the ring, where the groove 52 attaches to the ring 37. The hole 51 is above the passage 36. The bottom of the filler 50 can be easily attached to the protruding circumferential tenon, on the top surface 42 of the float member 40. The press plate 60 compresses the filler 50.

The press plate 60 compresses the filler 50 downwardly. The press plate 60 has a hole 61 that is approximately the same size of the hole 51. Several protruding broads 62 are assembled at the exterior of the press plate 60. At the center of the protruding broads 62, there is a hole 63, which allows the tenon 39 to be plugged in, and makes the press plate 60 to be tightly attached to the filler 50 above the housing 30.

Figure 4:
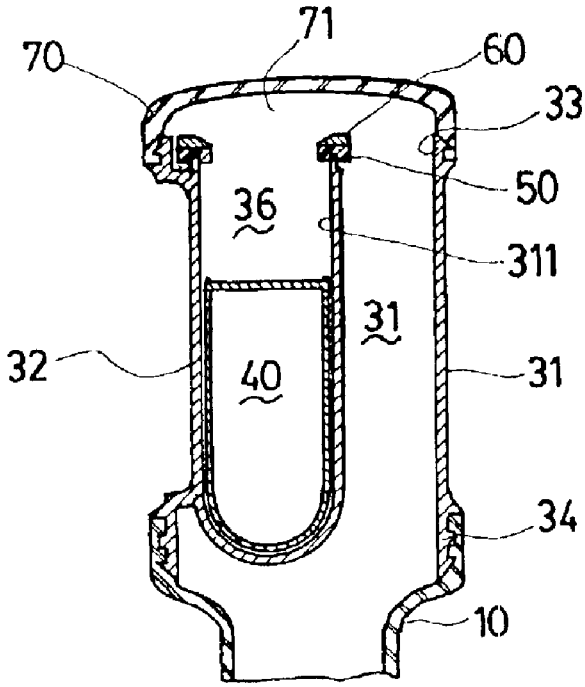
FIG. 4 is a sectional view taken along the line A—A of FIG. 2.
Figure 5:
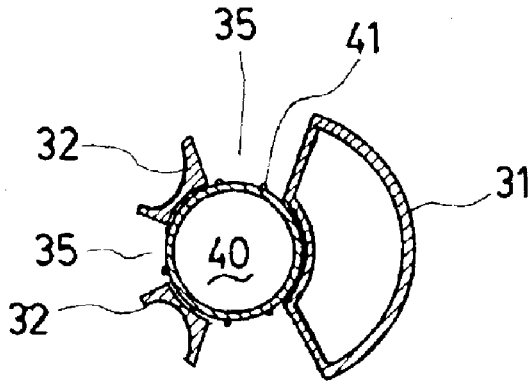
FIG. 5 is the B—B section view of FIG. 2.

The top cover 70 can be attached to the top edge 33. Referring to FIG. 4, the air can go through the hole 51, 61 of the filler 50, the press plate 60, and the space 71 below the top cover 70 to enter the inner of hollow tube 31 and then into snorkel tube 10.

The aperture 35 of housing 30 allows the air and water go through, when air into the passage 36 will follow the hole 51 to the snorkel tube 10; when water comes into the passage 36, the buoyant of water makes the float member 40 upward. If the water level keeps upwardly, the top of float member 40 will move upwardly and get in touch closely with the bottom of filler 50 stop water flow through holes 51 and 61. Even though the water pressure increases when the whole snorkel goes under the water level, the float member 40 can still tightly attach to the filler 50. By the way water still is not able to enter the hole 51; obviously, water then cannot enter the inner space of hollow tubes 31.

In conclusion, the present invention of water entering preventing protector can allow air in/out the snorkel easily but water does not.

It will now be understood that the invention herein disclosed meets all of the aforementioned objects. It will also be understood that while a preferred embodiment has been described in detail, the invention is not necessarily limited by such exemplary disclosure, but only by the appended claims and their equivalents.

What is claimed is:

1. A snorkel splash protector for use with a snorkel comprising:

a) a hollow housing connected to a top of a snorkel tube of the snorkel and having:

i) a hollow tube and a vertical tubing passage located on an interior thereof, the vertical tubing passage having a ring located on a top thereof;

ii) an interior wall formed between the hollow tube and the vertical tubing passage;

iii) a plurality of supports located on an exterior wall of the vertical tubing passage; and iv) a plurality of apertures formed between the plurality of supports, the vertical tubing passage communicating with an exterior of the snorkel through the plurality of apertures and an interior of the snorkel tube through the hollow tube;

b) a filler located on the ring of the vertical tubing passage and having a hole there through; further comprising a press plate located on a top of the filler, wherein the press plate includes a plurality of wings, each of the plurality of wings having a wing hole, the housing including a covering plate having at least one tenon inserted through the wing hole of at least one of the plurality of wings;

c) a top cover connected to a top of the housing; and d) a float member movable between closed and open positions, wherein, in the closed position, the float member engages the filler and seals the vertical tubing passage, and in the open position, the float member and the filler are spaced apart.

2. The snorkel splash protector according to claim 1, wherein the float member has a long rod shape.

3. The snorkel splash protector according to claim 1, wherein the float member is of a low density material.

4. The snorkel splash protector according to claim 1, wherein the float member has protruding stripes on an exterior thereof.

5. The snorkel splash protector according to claim 1, wherein the filler is made of a resilient material.

6. The snorkel splash protector according to claim 1, wherein the filler includes a groove, the ring of the vertical tubing passage inserted into the groove.

* * * * *